United States Patent [19]

Andersson et al.

[11] Patent Number: 4,573,931

[45] Date of Patent: Mar. 4, 1986

[54] ATTACHMENT MEANS FOR OUTBOARD MOTORS

[76] Inventors: Verner Andersson, Stationsgatan 1B; Kaj Andersson, Kasköplan 5, both of 824 00 Hudiksvall, Sweden

[21] Appl. No.: 666,348

[22] Filed: Oct. 30, 1984

[30] Foreign Application Priority Data

Nov. 1, 1983 [SE] Sweden ..... 8306003

[51] Int. Cl.[4] ..... B63H 5/12

[52] U.S. Cl. ..... 440/61

[58] Field of Search ..... 440/53, 57, 58–63; 114/123, 126, 201 R; 49/138, 276, 281, 330, 344; 298/22 R, 22 B, 22 D, 22 J; 74/3.52; 244/213, 225

[56] References Cited

U.S. PATENT DOCUMENTS 2,136,663 11/1938 Anthony ..... 298/22 D
2,966,876 1/1961 MacWilliam ..... 248/642
3,107,073 10/1963 Monroe ..... 248/642
4,362,513 12/1982 Hall et al. ..... 440/61
4,363,629 12/1982 Hall et al. ..... 440/61

FOREIGN PATENT DOCUMENTS 1028300 5/1981 Sweden .

*Primary Examiner*—Trygve M. Blix
*Assistant Examiner*—Jesús D. Sotelo
*Attorney, Agent, or Firm*—Burns, Doane, Swecker & Mathis

[57] ABSTRACT

An outboard motor attachment assembly comprises two assembly parts which are pivotally connected together, of which assembly parts a first part is arranged to be firmly secured to the stern transom of a boat and the second assembly part is provided with a support section for carrying the outboard motor. The angular position of the second part in relation to the first part is controlled by a control device acting upon a lever arm whose pivotal movement is limited by a stop on the second assembly part.

9 Claims, 5 Drawing Figures

Fig. 1
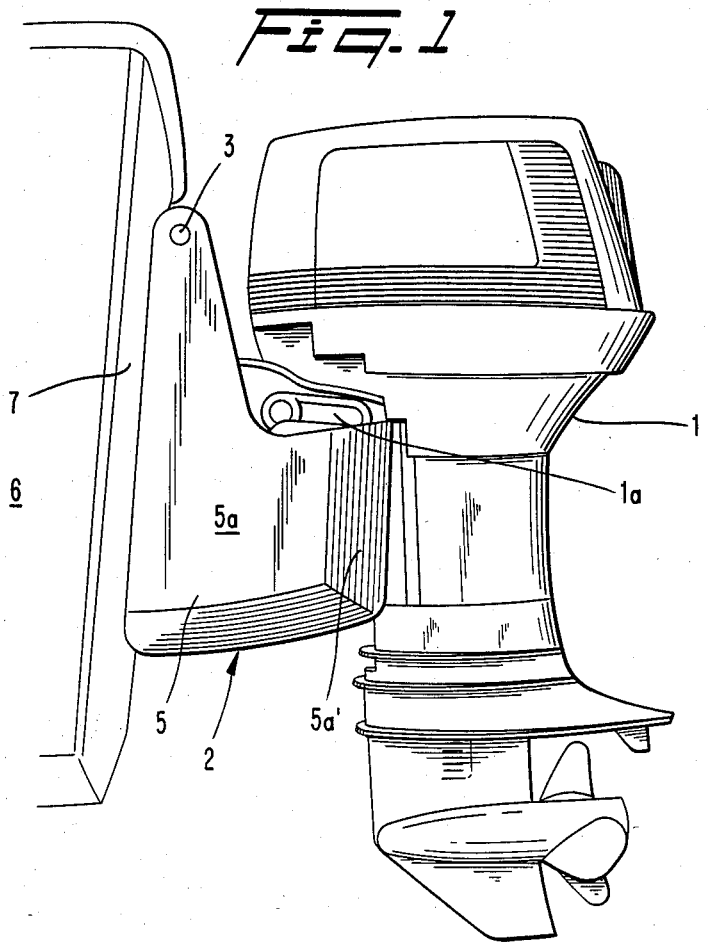
Fig. 2
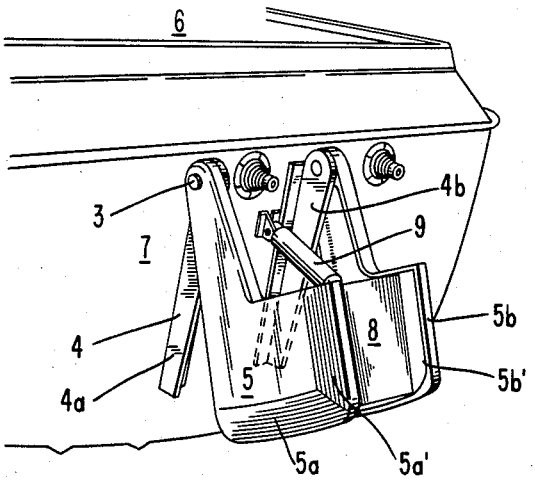
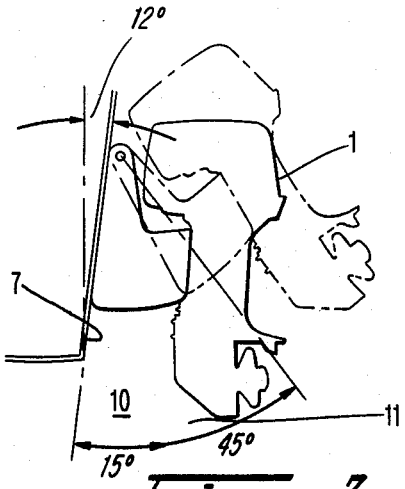
Fig. 3

ATTACHMENT MEANS FOR OUTBOARD MOTORS

TECHNICAL FIELD

The present invention relates to an attachment means for an outboard motor, and in particular to one such attachment means comprising two parts which are pivotally connected together and of which a first part is intended to be firmly mounted onto the stern transom of a boat and the second of which is provided with a supporting member on which the outboard motor is carried.

In order to be able to rotate the aforementioned two attachment parts relative to one another, so that the motor is able to take selected positions in fulfillment of a trimming function and also be capable of carrying out a tilting function, a control device is provided for regulating the rotational position of the second attachment part in relation to the first attachment part.

This control device is normally in the form of a hydraulic piston-cylinder assembly.

BACKGROUND ART

Various outboard-motor attachment assemblies of the aforementioned kind are known to the art.

In order to illustrate the state of the art, attention is drawn to the outboard-motor attachment assembly described in Swedish Patent Application 8102830-0. The attachment assembly of this application comprises two parts which are pivotally connected together through a pivot shaft and of which a first part is intended to be firmly secured to the stern transom of a boat and a second part is provided with an edge portion for supporting the outboard motor. It is proposed in this patent application that the pivot shaft between the two attachment parts is positioned over the edge portion at such a height thereabove that the pivot shaft is located adjacent the upper edge of the outboard motor.

In this known attachment assembly, the setting angle or position between the two attachment parts is adjusted with the aid of a hydraulic piston-cylinder device.

U.S. Pat. No. 4,363,629 discloses a marine power means comprising a first part in the form of a stern-transom attachment means arranged to be attached to the transom of a boat, and a second part in the form of a so-called transom attachment. There is also provided a pivot shaft which is arranged to connect the first part of the power means with the second part thereof, in a manner to enable the parts to be rotated in relation to one another about the pivot shaft.

This known assembly also includes a first hydraulic piston-cylinder device for adjusting the outboard motor to different angular positions in the fulfillment of a trimming function, and a second hydraulic piston-cylinder device for fulfillment of a desired tilting function of the outboard motor.

It is also known that the attitude of a boat in the water during passage therethrough can be adjusted by changing the angular position of the outboard motor in relation to the stern transom. A small angle causes the forward part of the boat to be pressed down, while a large angle causes the forward part of the boat to be lifted.

It is also known that a very large force is required to effect the aforementioned relative angular changes when the outboard motor is running, and that this force is much greater than the force required to rotate the outboard motor through much large angles when the motor is not running.

This angular adjustment, which is desirable during passage of the boat through the water, is referred to as the trimming function, while the angular adjustment desirable when the motor is not running is referred to as the tilting function.

It is also known that angular adjustment in respect of the trimming function must be more precise, despite the high forces generated, than the angular adjustment in respect of the tilting function.

It should also be mentioned that in the U.S. Pat. No. 4,362,513 it is previously known to use a toggle linkage to adjust the motor relative the boat within the trimming area and have a hydraulic means acting with a force on the common pivoting axis of the two links, usually having an obtuse angle.

DISCLOSURE OF THE INVENTION

Technical Problem

It will be seen from the aforedescribed state of the art that there is a need for a motor attachment assembly with which the trimming function can be fulfilled without requiring the use of special devices herefor.

Thus, there is a qualified need of providing such conditions that one and the same device, namely the device for adjusting the rotational position of the second attachment part in relation to the rotary position of the first part, can be used for both the trimming function and the tilting function.

A further need is one of providing a motor attachment assembly which comprises but few components and but one control device and still be capable of adjusting the angular values with regard to the trimming function with sufficient accuracy.

With respect to the fact that the power requirement for the device is much greater in regard of the trimming function than in regard of the tiling function, there is a need for a control device which operates with constant maximum force and with varying forces between the two parts of the attachment assembly.

When using one single control device for both the trimming function and tilting function there is a need to arrange for the device in its trimming function mode to co-act with power transmission means, such as rotary transmission means, such that the rotational movement of the second attachment part relative the first attachment part is smaller than the movement of the control means. On the other hand, in respect of the tilting function the movement of the second attachment part will be directly dependent upon the extent to which the control device is extended.

A further problem with such known attachment assemblies is one of arranging the control device to act between one part in the attachment and a lever arm of such nature that it contributes with a small relative movement between the first and the second attachment parts for a relatively large movement of the control device.

There is also a need for an outboard motor attachment assembly which while being of stable construction has but small dimensions, and incorporates given auxiliary devices which enable one and the same control device to be used advantageously in respect of both the trimming function and the tilting function.

In addition, it should be possible to take such measures that the maximum power output of the control device need not be adapted to the direct effect in the trimming function but solely to the direct effect in the tilting function.

It must be seen as a very complex technical problem to eliminate the previously known toggle linkage and the very high differencies between the low force acting on almost straight links in a toggle linkage and the high force acting on links in an obtuse angle.

It must be seen as a very complex technical problem to cause the force, acting for trimming purposes, to be more even during the whole trimming area and causing a reduced increase in the force when leaving the trimming area and starting the tilting area.

Solution

Accordingly, this invention relates to an outboard motor attachment assembly comprising two attachment parts which are pivotally connected together, namely a first attachment part arranged to be firmly secured to the stern transom of a boat, and a second attachment part provided with a support member arranged to carry the outboard motor, and a control device which extends between the first and the second attachment parts and which is arranged to adjust the rotary position of the second part in relation to the first part.

According to the invention this control device is arranged to co-act with a power transmission means and/or a movement transmission means when operating in the trimming mode, and to act directly between the two said assembly parts when functioning in the tiling mode.

In accordance with the invention the aforesaid means may have the form of a lever arm having one end pivotally connected to the second assembly part and the other end arranged for movement along the stern transom. The control device acts in a location between the aforesaid ends. The aforesaid arm is preferably slightly curved.

Preferably, the free end of the aforesaid means is arranged to run against a guide surface, which may be firmly attached to the stern transom or may form a part thereof.

Conveniently, stop means are provided for limiting the rotary movement of the lever arm about its one end, said stop means being attached to the second attachment part.

In this way, the lever arm is able to rotate during the trimming function under the action of a relatively small force from the control device, wherewith a relatively large displacement movement results in a trimming angle between the two attachment parts of, for example, up to 20°, while when the lever arm has rotated to an extent such that it rests against the stop means, the displacement movement of the control device results in a purely tilting function.

Advantages

The outboard motor attachment assembly according to the present invention affords the advantage that a single control device can effectively serve both the trimming function and tilting function of the outboard motor, and that the trimming function is effected through power transmission and/or a movement transmission means, thereby enabling the trimming function to be carried out with less power consumption than was previously the case when trimming a running motor.

The main characterizing features of an outboard motor attachment assembly according to the invention are set forth in the characterizing clause of claim 1.

BRIEF DESCRIPTION OF THE DRAWINGS

An embodiment of the invention possessing the significant characterizing features thereof will now be illustrated by way of example in the accompanying drawings, in which:

FIG. 1 is a side view of an outboard motor secured to the stern transom of the hull of a boat by means of an attachment assembly according to the invention;

FIG. 2 illustrates the attachment assembly connected to the boat hull, with the second attachment part of the assembly being shown in an inclined position for the tilting function;

FIG. 3 is a schematic side view of an outboard motor attachment assembly, illustrating the angular range for the trimming function and for the tilting function respectively;

DESCRIPTION OF A PREFERRED EMBODIMENT

Figure 4:
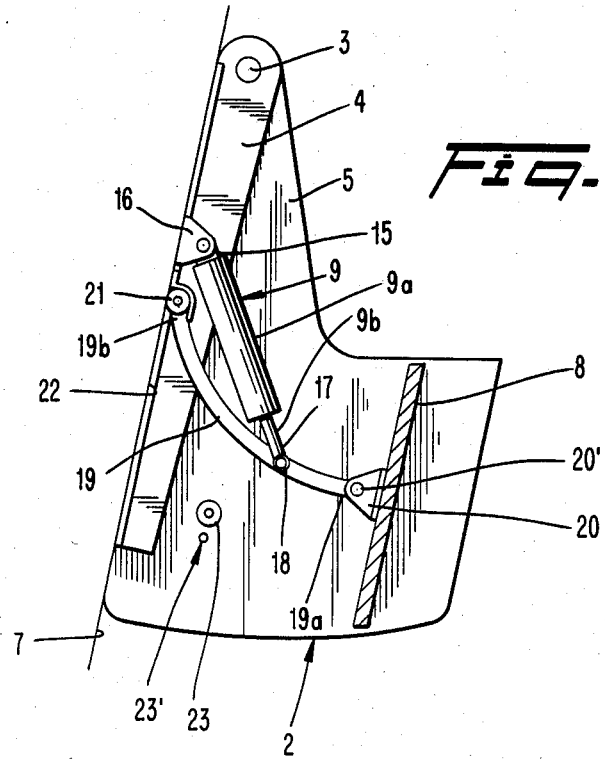
FIG. 4 is a sectional view of the attachment assembly illustrated in FIG. 2, clearly illustrating the significant structural elements of the invention and showing the second attachment part lying closely to the stern transom.

FIG. 1 is a side view of an outboard motor 1 which is firmly connected to an attachment assembly 2 according to the invention by means of conventional securing means 1*a*. The attachment assembly 2 comprises two parts 4,5 which are mounted for movement relative to one another on a pivot shaft 3. The first attachment part or base 4 is arranged to be firmly connected to the stern transom 7 of a boat 6, and the other attachment part or housing 5 is provided with a support section 8 for carrying the motor 1.

In the illustrated embodiment of FIG. 2, the first attachment part 4 comprises two mutually parallel bars 4*a* and 4*b*, both of which are secured to the stern transom 7 in a conventional manner by means not shown.

The upper parts of respectively bars 4*a*,4*b* are provided with a pin or a recess for a shaft serving as the pivot shaft 3.

It will be understood, however, that the bars 4*a* and 4*b* could be connected together to form a unit.

As shown in FIG. 2, the second attachment part 5 has the form of a unit comprising two side members 5*a* and 5*b* whose upper parts are provided with a pin or a recess for the pivot shaft 3.

The side members 5*a*, 5*b* are provided with sections 5*a*′ and 5*b*′ which project outwardly in relation to a support plate 8 and which are intended to guard the securing means 1*a* on the outboard motor 1.

The assembly also includes a control device 9 for controlling the rotational position of the second attachment part 5 in relation to the first attachment part 4. In the illustrated embodiment, this control device comprises a hydraulic piston-cylinder assembly. For the sake of simplicity, the requisite hose connections of the hydraulic cylinder have not been shown.

As beforementioned, by trimming function is meant here, and in the following, the controlable setting of the outboard motor 1 in relation to the stern transom 7 required in order for the hull of the boat to lie correctly in the water in response to the load to which the boat is subjected, the distribution of this load and the power output of the motor 1. FIG. 3 illustrates an angular range 10 within which the trimming function is assumed to lie. FIG. 3 also shows a further angular range 11 within which the tilting function takes place. It will be understood that when practicing the invention the dividing line between the trimming function and the tilting function can be varied.

Referring to FIG. 3, it will be seen that the tilting function is intended to take place within a region of 15°–45°, although this range can naturally be increased. In the embodiment illustrated in FIG. 3, the stern transom 7 forms an angle of 12° in relation to a vertical line, and it will be apparent that the trimming function, and trimming angles lying therewithin, is dependent upon the angle of the stern transom with the vertical plane, although in the illustrated embodiment it is assumed that the angular range 10 shall be up to 15°. A maximum angle of 20° is normally to be preferred.

The characteristic features of the invention are illustrated in more detail in FIG. 4. FIG. 4 illustrates the manner in which the first attachment part 4 is secured to the stern transom 7, and illustrates the second attachment part 5 in a position in which it lies close to the stern transom 7. The control device 9 for adjusting the angular position of the second attachment part 5 in relation to the first attachment part 4, is pivotally connected at one end 15 to an attachment 16 mounted on the sterm transom 7. The other end 17 of the device, constituting the free end of a piston rod, is pivotally connected at a location 18 to a lever arm 19. One end 19*a* of the lever arm 19 is pivotally connected to an attachment 20 which is firmly connected to the rear side of the support plate 8. Arranged on the other end 19*b* of the lever arm 19 is a support roller 21.

Thus, in the aforesaid trimming-function mode the device 9 co-acts with the power transmission and/or movement transmission means in the form of lever arm 19, while in the tilting function mode said device 9 acts directly between the two attachment parts 4 and 5. This latter will be described in more detail with reference to FIG. 5.

As beforedescribed, the one end 19*a* of the lever arm 19 is pivotally connected to the second attachment part 5, more specifically to the rear side of the support plate 8, and the other end 19*b* of the device 9 is arranged for movement along the stern transom 7 of the hull upon displacement movement of the device 9.

In the setting position of the attachment parts 4 and 5 illustrated in FIG. 4, the lever arm 19 is required to have a length which exceeds the distance between the pivot location 20' and the shortest distance to the stern transom 7. The free end 17 of the piston rod 9*b* acts at a location between the end parts of the lever arm. In the illustrated embodiment, the arm 19 is curved. Mounted on the end 19*b* of the lever arm 19 is a roller 21 which is intended to run along a guide surface 22 on the stern transom 7, this guide surface either being a separate element secured to the stern transom or forming an integral part thereof.

As illustrated, the second attachment part 5 is provided with stop means 23 which restrict the extent to which the lever arm 19 can rotate around its one end 19*a*.

When activating the control device 9, the piston rod 9*b* is extended from the cylinder 9*a*, causing the lever arm 19 to rotate about its axis 20' in the attachment 20. This rotational movement causes the roller 21 to run down the guide surface 22 and thus rotate the attachment part 5 in relation to the attachment part 4, about the pivot shaft 3 within the range 10 for the trimming function.

Figure 5:
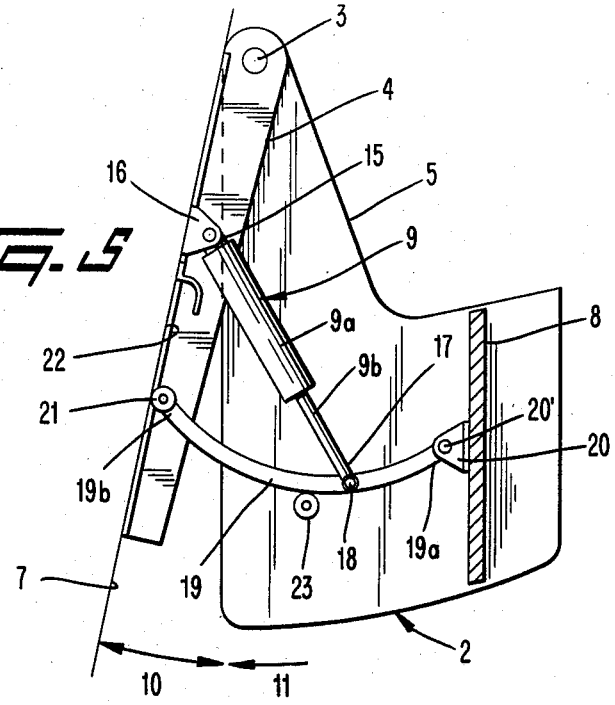
FIG. 5 illustrates the attachment assembly shown in FIG. 4 in which the second attachment part has been moved to a maximum position in the trimming mode.

FIG. 5 illustrates the lever arm 19 in its maximum trimming-function position. FIG. 5 shows the arm 19 resting against the stop 23 in said arm position. The lever arm 19 may be so dimensioned and arranged for rotation in the trimming-function mode that an angle of up to 20° can be formed between the first attachment part 4 and the second attachment part 5. Thereafter the lever arm 19 will rest against the stop 23 and any further activation of the control device 9 will result in commencement of the tilting function. Thus, in the tilting-function mode the second attachment part 5 will rotate relative to the first attachment part 4 directly in response to activation and movement of the control device 9.

FIGS. 4 and 5 thus illustrate that the force from the device 9, as a result of the arm 19 need not be in direct relationship with the force required for the trimming function, but is much lower due to the power transmission and/or movement transmission.

The force is used directly in the tilting-function mode, however,

As will be understood, the invention is not restricted to the use of a lever arm and that the arm can be replaced with any suitable mechanical power transmission and/or movement transmission means.

The trimming range can be readily altered, by changing the position of the stop means 23. When wishing to increase this range, the stop means is moved to the position 23' in FIG. 4.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are intended to be embraced therein.

What is claimed is:

1. An assembly for attaching an outboard motor to a boat hull, said assembly comprising:

an attachment base affixable to the boat hull;

an attachment housing having a support section for receiving an outboard motor;

means for pivotably attaching said attachment housing to said attachment base so that said attachment housing is angularly positionable about a first, approximately horizontal axis;

a lever arm having a first end and a free end;

means for pivotably attaching said first end of said lever arm to said attachment housing so that said lever arm is pivotable about a second, approximately horizontal axis;

stop means fixed to said attachment housing for limiting the pivoting motion of said lever arm;

controlled means connected to said lever arm at a location between said free end and said first end for selectively adjusting the angular position of said attachment housing, said controlled means adjusting the angular position of said attachment housing according to trim by pivoting said lever arm about said second axis with said free end in contact with and moving along said boat hull between a first lever position spaced from said stop means and a second lever position adjacent said stop means, said controlled adjusting means adjusting the angular position of said attachment housing to a tilting position by urging said lever arm against said stop means.

2. The assembly according to claim 1, wherein the lever arm is curved toward said first axis.

3. The assembly according to claim 2, wherein a guide surface is located on a transom of the boat hull for guiding said free end of the lever arm.

4. The assembly according to claim 3, wherein the lever arm at said second position places said attachment housing at an angle of up to 20° with respect to the attachment base.

5. The assembly according to claim 2, wherein the lever arm at said second position places said attachment housing at an angle of up to 20° with respect to the attachment base.

6. The asssembly according to claim 1, wherein a guide surface is located on a transom of the boat hull for guiding said free end of the lever arm.

7. The assembly according to claim 6, wherein the lever arm at said second position places said attachment housing at an angle of up to 20° with respect to the attachment base.

8. The assembly according to claim 1, wherein the lever arm at said second position places said attachment housing at an angle of up to 20° with respect to the attachment base.

9. The assembly according to claim 1, wherein a roller is affixed to said free end, said roller being in rolling contact with the boat hull when said lever arm is moved between said first and second lever positions.

* * * * *